US009583296B2

(12) United States Patent
Satou

(10) Patent No.: US 9,583,296 B2
(45) Date of Patent: Feb. 28, 2017

(54) VARISTOR FITTED WITH DEGRADATION ALARM

(71) Applicant: Panasonic Intellectual Property Management Co., Ltd., Osaka (JP)

(72) Inventor: Masaaki Satou, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 20 days.

(21) Appl. No.: 14/775,669

(22) PCT Filed: Feb. 26, 2014

(86) PCT No.: PCT/JP2014/001007

§ 371 (c)(1),
(2) Date: Sep. 12, 2015

(87) PCT Pub. No.: WO2014/147971

PCT Pub. Date: Sep. 25, 2014

(65) Prior Publication Data

US 2016/0027603 A1 Jan. 28, 2016

(30) Foreign Application Priority Data

Mar. 19, 2013 (JP) ..... 2013-056346

(51) Int. Cl.
*H01C 7/10* (2006.01)
*H01H 85/02* (2006.01)
(Continued)

(52) U.S. Cl.
CPC ..... *H01H 85/0241* (2013.01); *H01C 7/10* (2013.01); *H01C 7/126* (2013.01); *H01H 85/055* (2013.01)

(58) Field of Classification Search
CPC ..... H01C 7/10; H01H 85/0241
(Continued)

(56) References Cited

U.S. PATENT DOCUMENTS 5,502,612 A * 3/1996 Osterhout ..... H01C 7/12 361/117
5,982,603 A * 11/1999 Choi ..... H01C 1/1406 361/119

(Continued)

FOREIGN PATENT DOCUMENTS

JP 2009-218508 9/2009
JP 2011-083074 4/2011

OTHER PUBLICATIONS

International Search Report of PCT application No. PCT/JP2014/001007 dated Apr. 15, 2014.

*Primary Examiner* — Kyung Lee
(74) *Attorney, Agent, or Firm* — McDermott Will & Emery LLP

(57) ABSTRACT

A varistor provided with a degradation alarm function includes a first resistance element, an indicating element coupled in series with the first resistance element, a first thermal fuse coupled in parallel with a pair of the first resistance element and the indicating element, a varistor element coupled in parallel with the first thermal fuse, and a second resistance element disposed in an interconnect line between the first thermal fuse and the varistor element. A fusing temperature of the first thermal fuse is set such that the fuse is blown out at temperatures not lower than a temperature increased by heating when a current larger by a certain value than the maximum current rating of the varistor element passes through the fuse. The second resistance element is larger in resistance than the first resistance element.

4 Claims, 4 Drawing Sheets

(51) Int. Cl.
*H01C 7/12* (2006.01)
*H01H 85/055* (2006.01)

(58) Field of Classification Search
USPC ..... 338/21, 13
See application file for complete search history.

(56) References Cited

U.S. PATENT DOCUMENTS

| | | | | |
|---|---|---|---|---|
| 7,808,364 | B2 * | 10/2010 | Chou | H01C 7/102 337/183 |
| 2002/0054465 | A1 * | 5/2002 | Gerlach | H01T 4/06 361/111 |
| 2007/0217111 | A1 * | 9/2007 | Tseng | H02H 9/043 361/118 |
| 2008/0129440 | A1 * | 6/2008 | Ho | H01C 1/08 337/5 |
| 2009/0323244 | A1 * | 12/2009 | Hoopes | H02H 9/042 361/103 |

* cited by examiner

VARISTOR FITTED WITH DEGRADATION ALARM

CROSS-REFERENCE TO RELATED APPLICATIONS

This application is a U.S. national stage application of the PCT International Application No. PCT/JP2014/001007 filed on Feb. 26, 2014, which claims the benefit of foreign priority of Japanese patent application 2013-056346 filed on Mar. 19, 2013 the contents all of which are incorporated herein by reference.

TECHNICAL FIELD

The present invention relates to varistors provided with a degradation alarm function for use in switchboards and the like.

BACKGROUND ART

Conventionally, varistors have been used to protect switchboards against surges created by lightning. When a surge current flows in, the varistor can release the current to protect a switchboard against the surge. However, the inflow of an excessive surge current will cause to the varistor to go into a short mode, resulting in possible danger of ignition. On that account, a thermal fuse is connected in series to the varistor so as to cut off the varistor, thereby preventing the ignition. Moreover, when the varistor is cut off, an indication is also made to indicate that the varistor has been cut off.

Note that Patent Literature 1, for example, is known as information on the conventional technology related to the invention of the present application.

CITATION LIST

Patent Literature

PTL 1: Japanese Patent Unexamined Publication No. 2009-218508

SUMMARY OF THE INVENTION

The present invention is intended to provide a varistor provided with a degradation alarm function which includes: a first resistance element, an indicating element coupled in series with the first resistance element, a first thermal fuse coupled in parallel with a pair of the first resistance element and the indicating element, a varistor element coupled in parallel with the first thermal fuse, and a second resistance element disposed in an interconnect line between the first thermal fuse and the varistor element. A fusing temperature of the first thermal fuse is set such that the fuse is blown out at temperatures not lower than a temperature increased by heating when a current larger by a certain value than the maximum current rating of the varistor element passes through the fuse. The second resistance element is larger in resistance than the first resistance element.

With this configuration, the present invention can provide the varistor provided with the degradation alarm function having the following advantages. That is, when a current larger by a certain value than the maximum current rating passes through the varistor, the varistor is capable of indicating that the current has passed through it and capable of maintaining the continued varistor function.

DESCRIPTION OF EMBODIMENTS

Prior to descriptions of embodiments, problems of conventional varistors will be described.

In a conventional varistor, after its thermal fuse has been blown out, the varistor is in a state of being unconnected. Consequently, in such a state of being unconnected, if another surge current flows into the varistor, the varistor no longer protects a switchboard against the surge. Moreover, when the surge current is not so large, i.e. only slightly exceeding the maximum current rating, the surge current does not cause ignition and an immediate breakdown of the varistor. However, a repetition of such surge current can cause the varistor to gradually degrade, leading finally to a possible short mode.

Hereinafter, varistors provided with a degradation alarm function will be described according to the embodiments of the present invention, with reference to the accompanying Figures.

First Exemplary Embodiment

Figure 1:
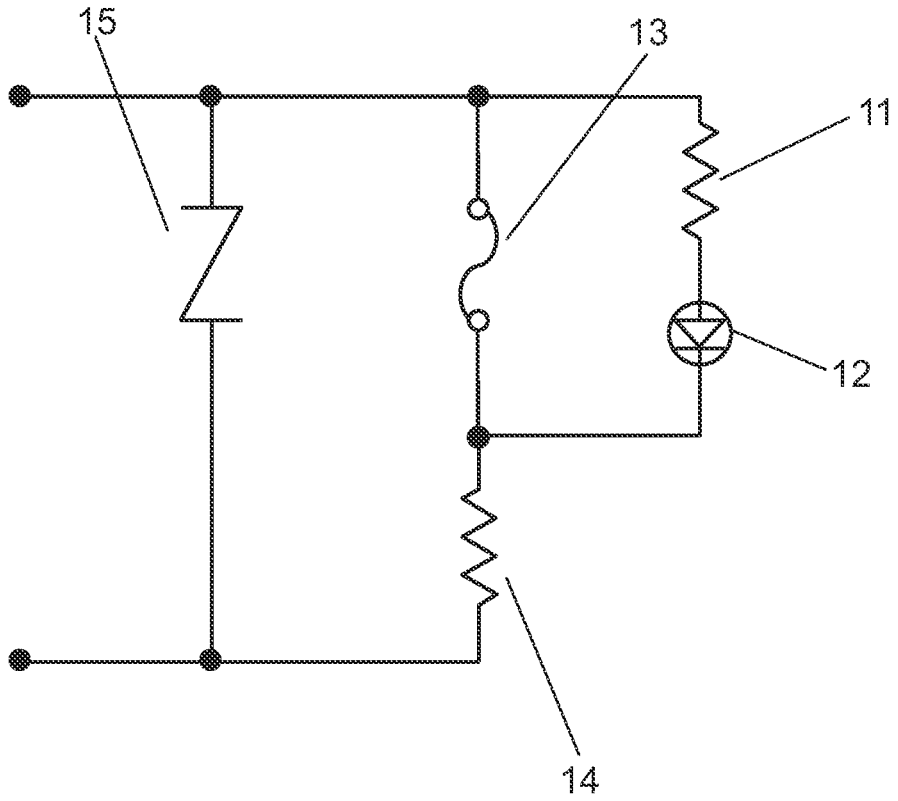
FIG. 1 is a circuit diagram of a varistor provided with a degradation alarm function according to a first embodiment of the present invention.
Figure 2:
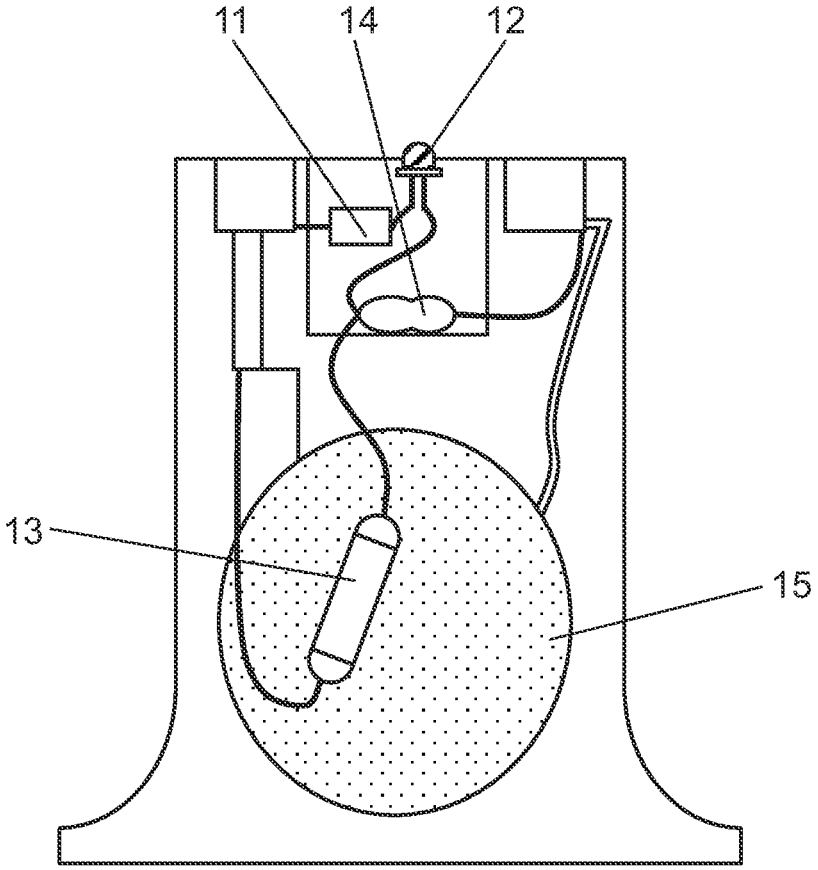
FIG. 2 is a schematic view of an inside of the varistor provided with the degradation alarm function according to the first embodiment of the invention.

FIG. 1 is a circuit diagram of a varistor provided with a degradation alarm function according to a first embodiment of the present invention. FIG. 2 is a schematic view of an inside of the varistor provided with the degradation alarm function according to the first embodiment of the invention. As shown in FIGS. 1 and 2, first resistance element 11 and indicating element 12 composed of an LED are coupled in series with each other. The series pair of first resistance element 11 and indicating element 12 is coupled in parallel with first thermal fuse 13. First thermal fuse 13 is coupled in parallel with varistor element 15. Second resistance element 14 is disposed in an interconnect line between first thermal fuse 13 and varistor element 15. First thermal fuse 13 is fixed in contact with varistor element 15, with an adhesive and the like.

Note that, in the embodiment, the resistance of first resistance element 11 is approximately 100Ω, while the resistance of second resistance element 14 is approximately 75 kΩ. In the embodiment, the resistance of second resistance element 14 is not smaller than 100 times larger than that of first resistance element 11. The internal resistance of first thermal fuse 13 is not larger than 10 mΩ. First thermal fuse 13 exhibits a fusing temperature of approximately 90° C.

The maximum current rating of varistor element 15 is 20 kA. A passing of a surge current of 20 kA through varistor element 15 increases the surface temperature of varistor element 15 to approximately 80° C. However, one time passing of a surge current of 30 kA (i.e. a current 1.5 times larger than the maximum current rating) through varistor element 15 does not cause varistor element 15 to break. The passing of the surge current of 30 kA through varistor element 15 increases the surface temperature of varistor element 15 to approximately 100° C. Usually, one time passing of the surge current about 1.5 times larger than the maximum current rating through varistor element 15 causes no breakdown of the varistor element, and results in only an increased temperature of the element. It is noted, however, that if a surge current exceeding the maximum current rating is repeatedly passed through varistor element 15, varistor element 15 is finally broken to go into a short mode, leading to a possible ignition.

Moreover, a passing of a surge current of 40 kA much larger than the maximum current rating through varistor element 15 increases the surface temperature of varistor element 15 to about 200° C., resulting in a breakdown of varistor element 15.

In the case where the thus-configured varistor provided with the degradation alarm function according to the first embodiment is connected to an apparatus, only a small amount of current passes through the path from first thermal fuse 13 though second resistance element 14. The internal resistance of first thermal fuse 13 is so very small that the resistance of second resistance element 14 can determine the current (leakage current) that passes through the path from first thermal fuse 13 through second resistance element 14.

On the other hand, because the resistance of first resistance element 11 is extremely large compared to the internal resistance of first thermal fuse 13, almost no current passes through indicating element 12, resulting in no lighting of indicating element 12. Therefore indicating element 12 is lit only when first thermal fuse 13 is being cut off.

Moreover, in order to reduce the amount of the leakage current, the resistance of second resistance element 14 is preferably set to be not smaller than 100 times larger than the resistance of first resistance element 11.

The passing of a current equal to its maximum current rating through varistor element 15 does not cause any change in the varistor provided with the degradation alarm function. However, the passing of a surge current, e.g. 30 kA, exceeding the maximum current rating (i.e. a current 1.5 times larger than the maximum current rating) through varistor element 15 increases the surface temperature of varistor element 15, resulting in fusing of first thermal fuse 13 that is in contact with varistor element 15. As a result, first thermal fuse 13 becomes in an open state. This causes the current to flow through the path through resistance element 11, indicating element 12, and second resistance element 14, which results in lighting-on of indicating element 12. At this time, because varistor element 15 is not broken by the current of about 30 kA (i.e. a current larger, by only a certain value, than the maximum current rating), varistor element 15 remains functioning, only with indicating element 12 indicating an alarm. Therefore, by recognizing the lighting-on of indicating element 12, a user is allowed to replace both varistor element 15 and first thermal fuse 13 with new ones, resulting in all-time protection of the apparatus by us g varistor element 15.

Second Exemplary Embodiment

Figure 3:
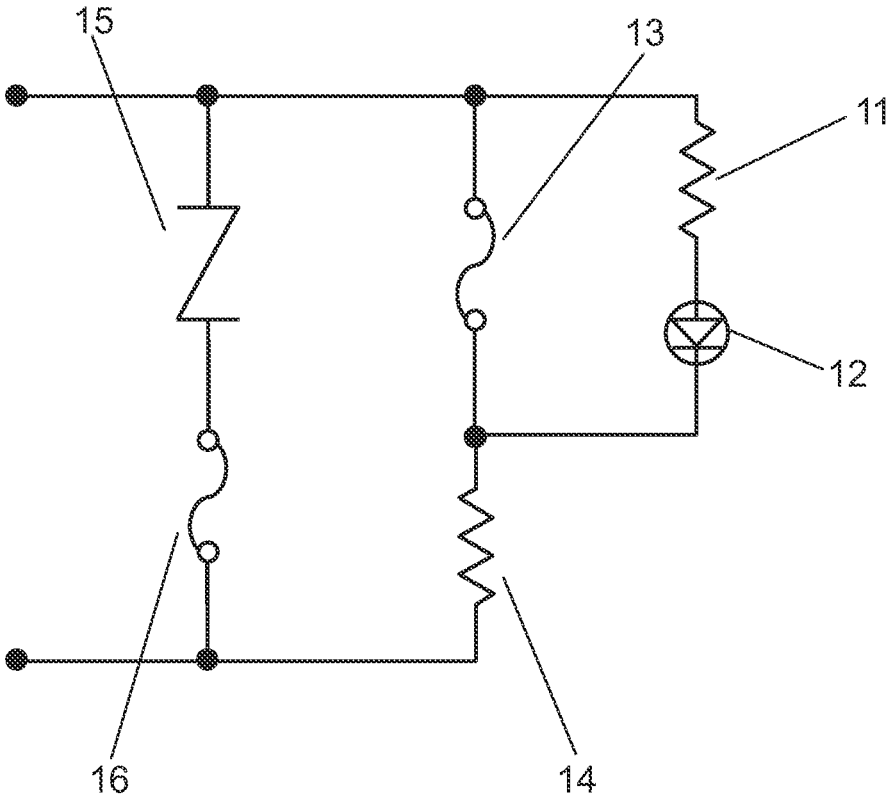
FIG. 3 is a circuit diagram of a varistor provided with a degradation alarm function according to a second embodiment of the present invention.
Figure 4:
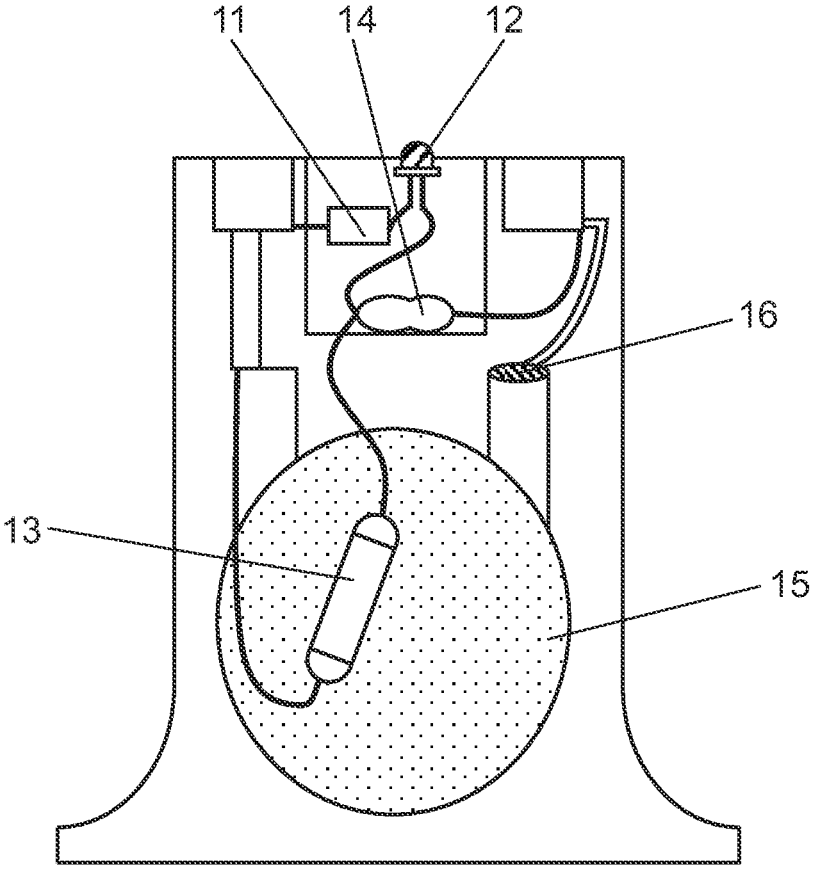
FIG. 4 is a schematic view of an inside of the varistor provided with the degradation alarm function according to the second embodiment of the invention.

Next, a second embodiment will be described. FIG. 3 is a circuit diagram of a varistor provided with a degradation alarm function according to the second embodiment of the present invention. FIG. 4 is a schematic view of an inside of the varistor provided with the degradation alarm function according to the second embodiment of the invention. The same constituent elements as those described in the first embodiment with reference to FIGS. 1 to 2 are designated by the same numerals and symbols, and a duplicate explanation thereof is omitted.

The configuration according to the second embodiment is different from that according to the first embodiment only in that second thermal fuse 16 is coupled in series with varistor element 15. Note that, the fusing temperature of second thermal fuse 16 is set to be higher than that of first thermal fuse 13. In the embodiment, the fusing temperature of second thermal fuse 16 is approximately 140° C., for example.

With the thus-configured varistor provided with the degradation alarm function according to the second embodiment, passing of a large surge current (e.g. a large current exceeding 40 kA) by which varistor element 15 would be broken, causes second thermal fuse 16 to be blown out, resulting in an open state of second thermal fuse 16. This prevents ignition of varistor element 15.

At the temperature (e.g. 100° C.) on the degree to which varistor element 15 is not broken, second thermal fuse 16 is not blown out, which allows varistor element 15 to hold the continued protection of the apparatus.

Note that a spring contact may be coupled with second thermal fuse 16 such that the contact causes a second indicating element (not shown) to light on when second thermal fuse 16 is blown out. With this configuration, the blowout of second thermal fuse 16 becomes easy to recognize.

It is noted, however, that the second indicating element is not always necessary as long as varistor element 15 and first thermal fuse 13 (and second thermal fuse 16) are replaced with new ones whenever first thermal fuse 13 is blown out. That is, indicating element 12 lights on in either of cases where only first thermal fuse 13 is blown out and where both first thermal fuse 13 and second thermal fuse 16 are blown out. Therefore, it is only required to replace varistor element 15 and first thermal fuse 13 (and second thermal fuse 16) with new ones in response to the light-on of indicating element 12. With this configuration, the circuit and structure can be made simpler, resulting in a reduced component count. In the absence of the second indicating element, a window may be preferably disposed in a case of the varistor provided with the degradation alarm function such that second thermal fuse 16 can be seen from the outside. Such a configuration causing second thermal fuse 16 to be visible from the outside, allows a user to see the state of second thermal fuse 16 through the window when indicating element 12 lights on. This makes it easy for a user to check second thermal fuse 16 for blowout.

INDUSTRIAL APPLICABILITY

The varistor provided with the degradation alarm function according to the present invention, provides the advantages that the varistor element thereof can maintain its function even when the varistor element is subjected to passing of a current larger by a certain value than its maximum current rating, and that a user can recognize the passing of the surge current. This allows the varistor to recover to the initial, state by replacing the varistor element and the thermal fuse with new ones.

The invention claimed is:

1. A varistor provided with a degradation alarm function the varistor comprising:

a first resistance element;

an indicating element coupled in series with the first resistance element;

a first thermal fuse coupled in parallel with a pair of the first resistance element and the indicating element;

a varistor element coupled in parallel with the first thermal fuse; and a second resistance element disposed in an interconnect line between the first thermal fuse and the varistor element, wherein a fusing temperature of the first thermal fuse is set such that the fuse is blown out at temperatures not lower than a temperature increased by heating when a current larger by a certain value than a maximum current rating of the varistor element passes through the fuse; and the second resistance element is larger in resistance than the first resistance element.

2. The varistor provided with the degradation alarm function according to claim 1, wherein the fusing temperature of the first thermal fuse is set such that the fuse is blown out at temperatures not lower than a temperature increased by heating when a current 1.5 times larger than the maximum current rating of the varistor element passes through the fuse.

3. The varistor provided with the degradation alarm function according to claim 1, further comprising a second thermal fuse coupled in series with the varistor element, wherein a fusing temperature of the second thermal fuse is set to be higher than the fusing temperature of the first thermal fuse.

4. The varistor provided with the degradation alarm function according to claim 1, wherein the second resistance element is not smaller than 100 times larger in resistance than the first resistance element.

* * * * *